US005834711A

United States Patent [19]

Haines

[11] Patent Number: 5,834,711

[45] Date of Patent: Nov. 10, 1998

[54] SOUND CONTROL THROUGH RESONANCE DAMPING

[75] Inventor: James C. Haines, Littleton, Colo.

[73] Assignee: Johns Manville International, Inc., Denver, Colo.

[21] Appl. No.: 890,722

[22] Filed: Jul. 9, 1997

[51] Int. Cl.[6] ..... E04B 1/82

[52] U.S. Cl. ..... 181/290; 181/295

[58] Field of Search ..... 181/207, 208, 181/210, 284, 286, 287, 288, 290, 294, 295

[56] References Cited

U.S. PATENT DOCUMENTS

| | | | |
|---|---|---|---|
| 2,036,467 | 4/1936 | Ellis | 181/290 |
| 2,229,255 | 1/1941 | Park | 181/290 |
| 3,786,898 | 1/1974 | Fujii | 181/295 |
| 5,245,141 | 9/1993 | Fortez et al. | 181/290 |

*Primary Examiner*—Khanh Dang
*Attorney, Agent, or Firm*—Robert D. Touslee

[57] ABSTRACT

Airborne resonance buildup (in directions parallel with and/or at acute angles to the first and second major skins or panels of enclosed cavities) is damped by locating anisotropic porous damping materials within the cavity between the first and second major skins or panels of the cavities. In one preferred embodiment, one or more anisotropic fibrous blankets are located between the skins of a cavity with the fibers of the blanket(s) lying in planes generally perpendicular to the first and second skins and parallel to one pair of the sidewalls of the cavity. In another embodiment, layered insulation modules of insulation blankets are located in the cavity in a checkerboard or parquet pattern so that the fibers in the insulation blankets of a first set of modules lie in planes extending generally perpendicular to a first opposed pair of cavity sidewalls and the fibers in the insulation blankets of a second set of modules lie in planes extending generally perpendicular to a second opposed pair of cavity sidewalls. In another embodiment, only the perimeter of the cavity is insulated with the fibrous insulation blanket(s) and a non-insulated generally centrally located air space, within the cavity, extends between the skins of the cavity and has a perimeter defined, at least in part, by spaced apart, opposed surfaces of the fibrous insulation blanket(s).

36 Claims, 2 Drawing Sheets

FIG. 1
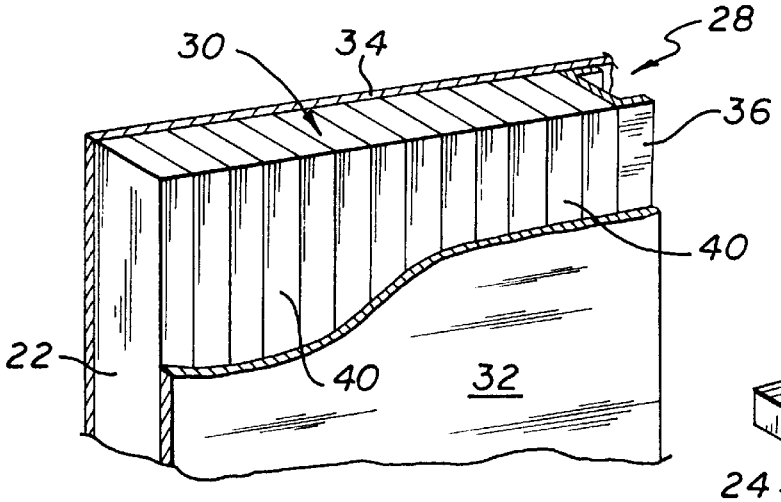
FIG. 9
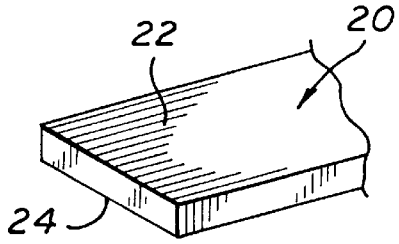
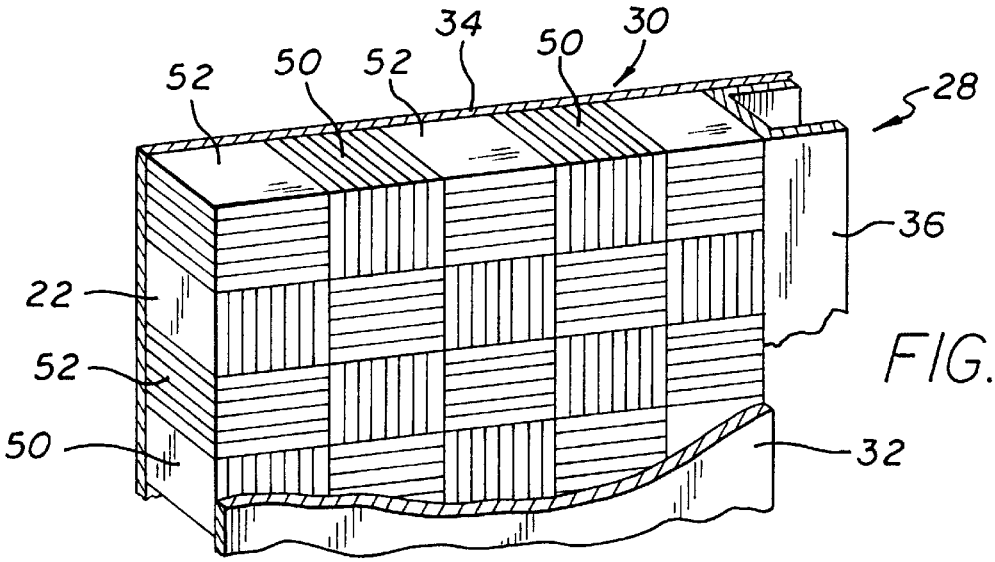
FIG. 4
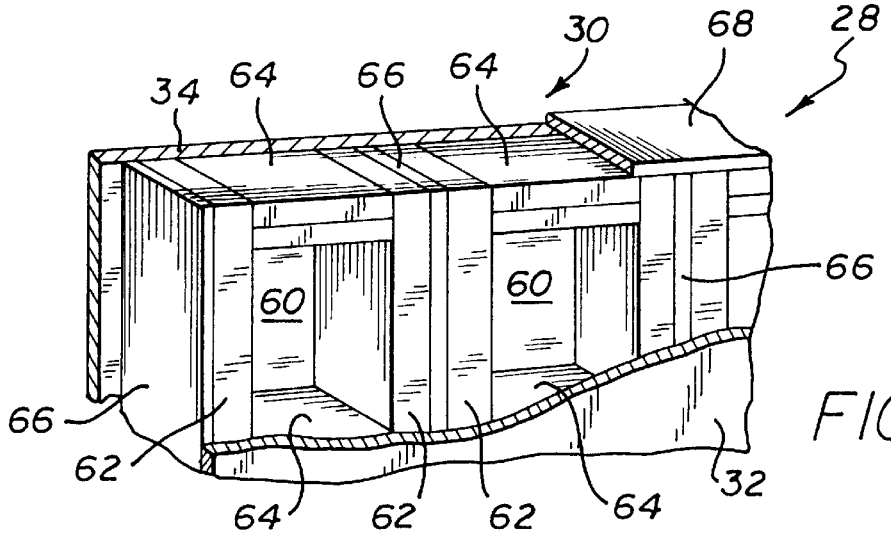
FIG. 8

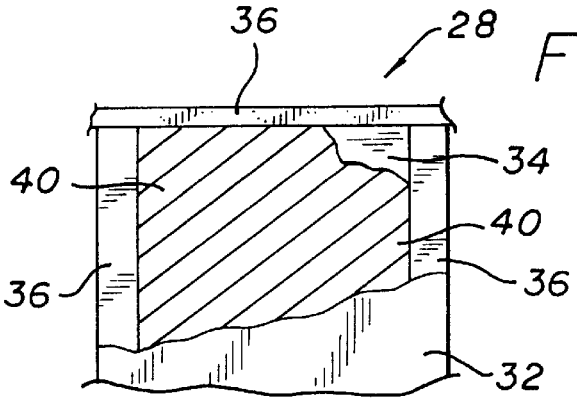
FIG. 2
FIG. 3
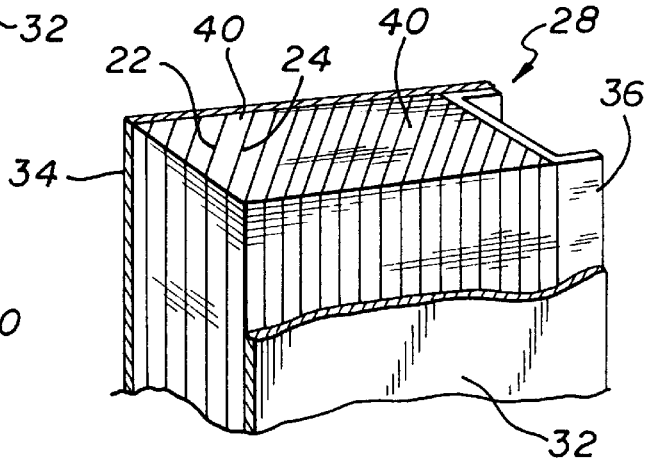
FIG. 5
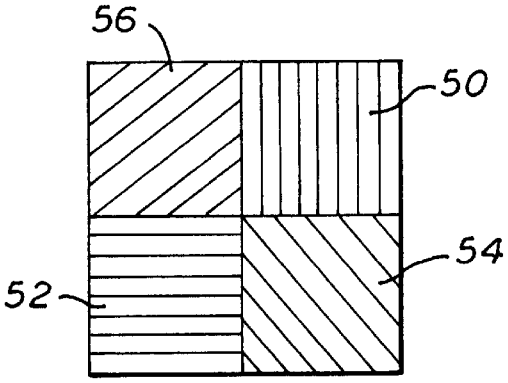
FIG. 6
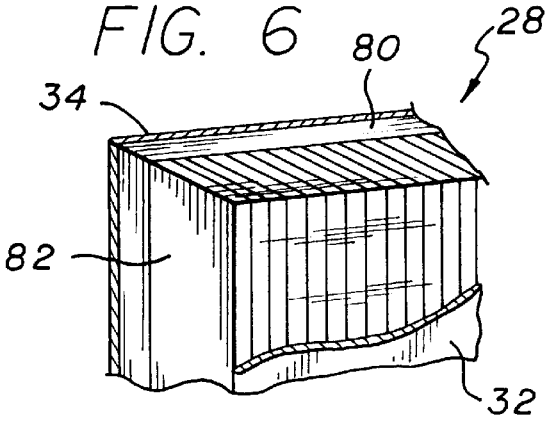
FIG. 7
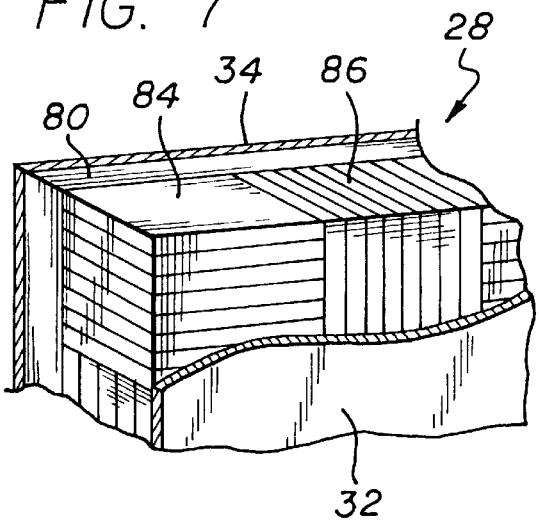
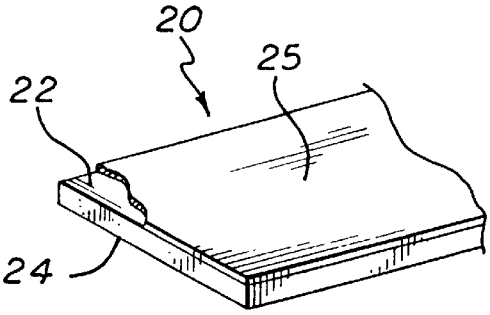
FIG. 10

SOUND CONTROL THROUGH RESONANCE DAMPING

BACKGROUND OF THE INVENTION

The present invention relates to the control of acoustic (airborne) resonance buildup in enclosed cavities and, in particular, to sound control through airborne resonance damping within an enclosed cavity by means of anisotropic damping materials which exhibit higher air flow resistances for a given thickness in a first direction than in a second direction perpendicular to or substantially perpendicular to the first direction.

In many environments where hollow wall structures or other structures with enclosed cavities are present, a large amount of the energy, which passes through the hollow wall from one skin or panel of the hollow wall to the other skin or panel of the hollow wall, is a result of airborne resonances which occur within the enclosed cavity in a direction other than perpendicular to the skins or panels i.e. parallel with or at acute angles to the skins or panels of the hollow wall. In these structures there is frequently a need to control or damp the buildup of airborne resonances within an enclosed cavity or cavities in order to reduce the transfer of sound through the structure. Examples of structures where airborne resonance damping may be required are aircraft fuselages where there is a need to damp airborne resonance buildup within the fuselage cavities to minimize the transmission of sound from the aircraft engines or from air flow generated noise to the passenger compartments or other areas. Other examples of structures where airborne resonance damping may be desired include partitions and walls in commercial and residential buildings where there is a need to minimize the transmission of sounds between adjacent rooms, etc. by controlling or damping airborne acoustical resonance buildup within the hollow walls (interior and/or exterior walls) separating a room or rooms from a source noise source. The terms "enclosed cavity" and "enclosed cavities" as used herein refer to a structural cavity or cavities whether such structural cavity or cavities are located in non-load bearing structures (e.g. double wall panels or partitions consisting of two thin sheet metal skins separated and supported by lightweight framing members and not used to support other portions of a structure) or in load bearing structures (e.g. a building wall supporting, at least in part, other portions of the structure).

SUMMARY OF THE INVENTION

In the method and structure of the present invention, an enclosed cavity, such as an enclosed cavity in an aircraft fuselage or a wall structure having outer and inner spaced apart skins or panels, is insulated with an anisotropic porous, damping material or materials. The anisotropic porous damping materials used in the present invention, have a higher air flow resistance in a first direction than in a second direction or directions perpendicular to or substantially perpendicular to the first direction.

While other anisotropic porous damping materials can be used as the damping materials in the present invention, certain anisotropic porous fibrous insulation blankets (faced or unfaced) perform very well in the method and structure of the present invention. The fibers of these fibrous insulation blankets, such as but not limited to air-laid glass fiber insulation blankets, lie predominately in planes extending parallel with or substantially parallel with first and second major surfaces of the fibrous insulation blankets and the air flow resistance through such fibrous insulation blankets is greater in a direction normal to the major surfaces of the fibrous insulation blankets than in the directions parallel with the major surfaces of the fibrous insulation blankets. Thus, by placing such fibrous blankets within an enclosed cavity with the planes containing the fibers oriented perpendicular to or at acute angles to the spaced apart skins or panels of the cavity, airborne resonance buildup within the enclosed cavity in a direction or directions at acute angles to and/or parallel with the spaced apart skins or panels is damped by the energy dissipated through the resistance of the damping material to the movement of the air or gas within the enclosed cavity in a direction or directions at acute angles to and/or parallel with the spaced apart skins or panels.

While faced and unfaced anisotropic porous fibrous insulation blankets are one preferred damping material, other porous materials with anisotropic air flow resistance properties, such as porous foam sheets, can also be used as the damping material or materials. In addition, various anisotropic porous damping materials can be used in combination to damp airborne resonance buildup within an enclosed cavity, such as alternate layers of different porous fibrous blankets (either faced or unfaced) or alternate layers of porous fibrous blankets and porous foam sheets (either faced or unfaced).

In one preferred embodiment of the present invention, the fibrous insulation blanket or blankets are located within the enclosed cavity between the first and said second skins or panels so that the first and second major surfaces of the fibrous insulation blankets and the fibers of the fibrous insulation blankets lie in planes extending perpendicular to or substantially perpendicular to the first and second skins or panels of the enclosed cavity and parallel or substantially parallel to a first pair of opposed sidewalls of the enclosed cavity. With this orientation of the insulation blankets, the higher air flow resistant direction through the insulation blankets is parallel to the first and second skins or panels to damp airborne resonance buildup within the enclosed cavity in a direction parallel with the first and second spaced apart skins or panels and perpendicular to the first pair of opposed cavity sidewalls.

In another preferred embodiment of the present invention, layered insulation modules of insulation blankets are placed in the enclosed cavity in a checkerboard or parquet pattern so that the fibers in the insulation blankets of a first set of modules lie in planes extending perpendicular or substantially perpendicular to both the spaced apart skins or panels and a first pair of opposed cavity sidewalls and the fibers in the insulation blankets of a second set of modules lie in planes extending perpendicular or substantially perpendicular to both the spaced apart skins or panels and a second pair of opposed cavity sidewalls. This placement of the layered insulation modules within an enclosed cavity, damps airborne resonance buildup in directions parallel with the first and second spaced apart skins or panels of the enclosed cavity as well as in the directions parallel with the first and second pairs of opposed cavity sidewalls.

In another embodiment of the invention for airborne resonance damping within an enclosed cavity, fibrous insulation blankets are located in the enclosed cavity adjacent to at least a first pair of opposed cavity sidewalls leaving a void or air space in the central portion of the enclosed cavity which is not insulated. Fibrous insulation blankets can also be located in the enclosed cavity adjacent to a second pair of opposed cavity sidewalls and the fibers in the blankets can be oriented to lie in planes extending perpendicular to or substantially perpendicular to the spaced apart skins or panels of the enclosed cavity as well as at least one pair of the opposed cavity sidewalls to damp airborne resonance buildup.

As discussed above, while porous fibrous insulation blankets (faced or unfaced) are a preferred damping material and have been referred to in illustrating different preferred embodiments of the invention, other faced or unfaced porous damping materials having anisotropic air flow resistance properties can also be used as the damping material in the method and structure of the present invention.

In similar embodiments to those discussed above, the higher air flow resistant direction(s) through the insulation materials can also be oriented to extend at angles to the skins of the enclosed cavity other than parallel with or perpendicular to the skins, such as, at various angles to the three orthogonal axes. In addition in a layered construction, layers of the anisotropic porous damping materials can be arranged in the enclosed cavities with one or more layers having the higher air flow resistant direction through the damping materials extending perpendicular to the skins of the enclosed cavities and one or more layers having the higher air flow resistant direction through the damping materials extending at angles to the skins of the enclosed cavities (e.g. at acute angles or parallel to the skins).

BRIEF DESCRIPTION OF THE DRAWINGS

FIG. 1 is a perspective view of an enclosed cavity provided with a series of anisotropic porous damping material layers with the higher air flow resistance direction through the damping material layers extending generally parallel with the surface panels of the cavity for sound control through airborne resonance damping.

FIG. 2 is a front elevation of a hollow wall cavity, with a portion broken away, showing a series of anisotropic porous damping material layers with the higher air flow resistant direction through the damping material layers extending generally parallel with the surface panels and at an angle to both the horizontal and vertical for airborne resonance damping.

FIG. 3 is a perspective view of an enclosed cavity provided with a series of anisotropic porous damping material layers with the higher air flow resistant direction through the damping material layers extending at an angle other than parallel or perpendicular to the surface panels of the cavity for airborne resonance damping.

FIG. 4 is a perspective view of an enclosed cavity provided with a checkerboard or parquet arrangement of anisotropic porous damping material layers with the higher air flow resistant direction through the damping material layers extending generally parallel with the surface panels for sound control through airborne resonance damping.

FIG. 5 is a front elevational view of an alternative checkerboard or parquet arrangement of anisotropic porous damping material layers with the higher air flow resistant direction through the damping material layers extending generally parallel with the surface panels for airborne resonance damping.

FIG. 6 is a perspective view of an enclosed cavity with anisotropic porous damping material layers arranged with their higher air flow resistant direction through the damping material layers extending perpendicular to and generally parallel with the wall panels of the cavity for airborne resonance damping.

FIG. 7 is a perspective view of an enclosed cavity with anisotropic porous damping material layers arranged with the higher air flow resistant direction through the damping material layers extending perpendicular to and, in a parquet arrangement, generally parallel with the wall panels of the cavity for airborne resonance damping.

FIG. 8 is a perspective view of an enclosed cavity provided with anisotropic porous damping materials about the periphery of the cavity for sound control through airborne resonance damping.

FIG. 9 is a perspective view of an anisotropic porous insulation material used as the air flow damping material in the method and structure of the present invention.

FIG. 10 is a perspective view of a anisotropic porous insulation material, with a high air flow resistant facer, used as the air flow damping material in the method and structure of the present invention.

DESCRIPTION OF THE PREFERRED EMBODIMENTS

In the method of the present invention for controlling airborne resonance within an enclosed cavity and the sound controlled structures with enclosed cavities of the present invention, an anisotropic porous damping material is used to damp sound within the cavity. While fibrous anisotropic insulation blankets, such as the blankets 20 shown in FIG. 9 and 10, are a preferred damping material, other materials having anisotropic air flow resistance properties may also be used. Although the air flow resistance properties of porous foam materials are not normally anisotropic, foams may be used as the damping material in the present invention provided the air flow resistance through the foam material for a given thickness or unit length in a first direction is higher than in a second direction perpendicular or substantially perpendicular to the first direction. Whether the damping material is a fibrous, foam or some other porous anisotropic material, at least some of the damping material is placed in the enclosed cavity so that the higher air flow resistant direction through the damping material (e.g. the fibrous layers, porous facing sheets. etc.) extends in a direction or directions other than perpendicular to the spaced apart skins or panels 32 and 34 of the enclosed cavity 30 (e.g. at an acute angle or parallel with the spaced apart skins 32 and 34).

When the anisotropic damping material or materials are layered within the cavity 30, such as shown in FIGS. 1 to 8, one or more different anisotropic porous damping materials may be used to damp airborne resonance buildup within the cavity. For example, in the embodiment of FIG. 1, selected or alternate layers of the anisotropic damping material layers 40 may be different fibrous blankets and/or different fibrous blankets and other damping materials with anisotropic air flow resistance properties such as certain foam sheets. In a like manner, selected or alternate layers of the anisotropic damping material layers 50 and 52 of one or both sets of the modules of the embodiment of FIG. 4 or the anisotropic damping materials 64 and 66 of FIG. 8 may be of different anisotropic materials, such as, different fibrous blankets and/or different fibrous blankets and other damping materials with anisotropic air flow resistance properties such as certain foam sheets.

Where a fibrous insulation blanket is used as the anisotropic damping material to dampen acoustic resonance buildup within the enclosed cavity 30, fibrous insulation blankets 20 of mineral fibers, such as glass fibers, fibrous insulation blankets of polymeric or other synthetic fibers, or other fibrous blankets including fiber blends may be used. The fibers of these batts or blankets 20 may be bonded together with a binder (e.g. phenol/formaldehyde resole resins or water deliverable acrylic latex based binders), by heat bonding or by other bonding means (hereinafter "bonded fibrous insulation blankets"). The batts or blankets may also be binderless or essentially binderless (i.e. quantitatively less than 1% binder by weight) and the fibers of these batts or blankets 20 may be held together by fiber entanglement (hereinafter "unbonded fibrous insulation blankets"). In addition, the bonded or unbonded fibrous insulation blankets 20 may be encapsulated within a perforated film such as a thin, perforated polymeric film, or the blankets may be provided with an air flow resistant facing sheet or element such as shown in FIG. 10 and described in U.S. Pat. No. 5,459,291, issued Oct. 17, 1995, "Sound Absorption Laminate". The disclosure of U.S. Pat. No. 5,459,291, is hereby incorporated herein in its entirety.

While the densities of the fibrous insulation blankets can vary over a larger range, preferably, the fibrous insulation blankets 20 range in density from about 0.25 pounds/$ft^3$ to about 2.0 pounds/$ft^3$ and most preferably from about 0.25 pounds/$ft^3$ to about 0.6 pounds/$ft^3$. The mean fiber diameter of the fibers in glass fiber insulation blankets 20 can also vary over a broader range, but preferably ranges from about 0.6 microns to about 7 microns and most preferably from about 1.0 micron to about 5 microns. The mean fiber diameter of the fibers in polymeric fiber insulation blankets preferably ranges from about 1 micron or less to about 20 microns.

The fibrous insulation blankets 20 of FIGS. 9 and 10 are preferably formed by a conventional air-laid process, such as, the pot and marble flame attenuation processes or the rotary fiberization processes commonly used to form fibrous insulation blankets in the glass fiber industry. The fibers in such air-laid glass fiber insulation blankets 20 predominately lie in and are randomly oriented in planes extending parallel with or substantially parallel with the major surfaces 22 and 24 of the fibrous insulation blankets 20. The fibers of other fibrous insulation blankets 20, such as certain polymeric fiber blankets, used for the damping material predominately lie in and are randomly oriented in planes extending at acute angles, e.g. about 45°, to the major surfaces 22 and 24 of the fibrous insulation blankets 20. With these fiber orientations, the fibrous insulation blankets 20 exhibit higher air flow resistances and greater sound absorbing properties, for a given thickness or unit length of the fibrous insulation blankets 20, in a direction intersecting, e.g. perpendicular or at an acute angle to, the major surfaces 22 and 24 of the fibrous insulation blankets than in a direction or directions parallel with the major surfaces 22 and 24 of the fibrous insulation blankets 20.

FIG. 1 shows a portion of a hollow wall 28 with an enclosed cavity 30 (e.g. a cavity in a load or non-load bearing double wall or hollow wall structure) having: a first skin or panel 32, a second skin or panel 34 spaced from and typically extending parallel with or substantially parallel with the first skin or panel 32; and two or four frame members 36 (only one of which is shown) which together form the boundaries of the enclosed cavity 30. The enclosed cavity 30 can be located in any structure where sound is being transmitted through a hollow wall due, at least in part, to airborne resonance buildup within the enclosed cavity in a direction or directions parallel to and/or at acute angles to the first and second skins or panels 32 and 34 of the wall, such as but not limited to, aircraft fuselages and commercial and residential building partitions and walls. While the anisotropic damping materials would also damp airborne resonance buildup within the enclosed cavity 30 in directions normal or perpendicular to the skins 32 and 34, the anisotropic damping materials, as described herein, are positioned within the enclosed cavity 30 with the higher air flow resistant direction through the damping materials oriented to provide the most effective damping in directions parallel with or at acute angles to the planes of the skins 32 and 34.

As shown in the preferred embodiment of FIG. 1, a series or plurality of fibrous insulation blanket strips 40 made from the faced or unfaced fibrous blankets 20 of FIGS. 9 and 10 are placed in the enclosed cavity 30 so that the major surfaces 22 and 24 of the fibrous insulation blanket strips 40 are perpendicular or substantially perpendicular to the skins or panels 32 and 34 of the enclosed cavity 30. With the strips 40 positioned between the skins or panels 32 and 34 of the enclosed cavity in this manner, the fibers of the fibrous insulation strips 40 predominately lie in and are randomly oriented in planes extending perpendicular to or substantially perpendicular to the planes of the skins or panels 32 and 34 and the higher air flow resistance through the fibrous insulation blanket strips 40 is parallel with or at acute angles to the planes of the skins or panels 32 and 34. Thus, by placing the fibrous insulation blanket strips 40 within the enclosed cavity 30 so that the strips extend vertically with the major surfaces 22 and 24 of the fibrous insulation blanket strips 40 perpendicular or substantially perpendicular to the skins or panels 32 and 34 of the enclosed cavity, the fibrous insulation blanket strips 40 more effectively dissipate or drain the airborne resonance energy and prevent airborne resonance buildup within the enclosed cavity in a direction or directions parallel with or at acute angles to the skins or panels 32 and 34 of the enclosed cavity 30.

Where the fibers of the fibrous insulation blanket strips 40 predominately lie in and are randomly oriented in planes extending parallel with or substantially parallel with the major surfaces 22 and 24 of the fibrous insulation blanket strips 40, the most effective damping of the airborne resonance energy in the enclosed cavity of FIG. 1 takes place in a horizontal direction parallel with the planes of the skins or panels 32 and 34. If such fibrous blanket strips 40 were positioned in the enclosed cavity in horizontally extending layers rather than vertically extending layers, the most effective damping of airborne resonance energy in the structural cavity of FIG. 1 would take place in a vertical direction parallel with the planes of the skins or panels 32 and 34. Where the fibers of the fibrous insulation blanket strips predominately lie in and are randomly oriented in planes extending at angles to the major surfaces 22 and 24 of the blanket strips but still perpendicular to the end edges of the blanket strips, such as in certain of the polymeric fiber blankets discussed above, the most effective damping of the airborne resonance energy in the enclosed cavity of FIG. 1 will take place in a direction parallel to the planes of the skins or panels 32 and 34 and perpendicular to the planes containing the randomly oriented fibers.

FIG. 2 shows an enclosed cavity 30 wherein the fibrous insulation blanket strips 40 (either faced or unfaced) are installed within the cavity with the major surfaces 22 and 24 oriented at an angle to both the vertical and the horizontal and perpendicular to the skins 32 and 34. FIG. 3 shows an enclosed cavity 30 wherein the fibrous insulation blanket strips 40 (either faced or unfaced) are installed within the cavity with the major surfaces 22 and 24 of the fibrous insulation blanket strips oriented at an angle other than perpendicular to the skins 32 and 34. While the fibrous insulation blanket strips 40 are shown extending vertically in FIG. 3 to damp an airborne resonance buildup in a generally horizontal direction or directions, the fibrous insulation blanket strips could also extend horizontally to damp an airborne resonance buildup in a generally vertical direction or directions. In addition, for certain selected applications of the embodiments of FIGS. 1–3, it may be desirable to use damping material layers 40 of different damping materials (either faced or unfaced) exhibiting anisotropic air flow resistance properties, such as but not limited to, glass fiber blankets and polymeric fiber blankets, combinations of different mineral fiber blankets, fibrous blankets and other damping materials such as foam, or porous foam sheets and other porous damping materials.

FIG. 4 shows another preferred embodiment of the present invention wherein a first series of fibrous insulation blanket strips 50 and a second series of fibrous insulation blanket strips 52, both of which may be in modular form, are located in the enclosed cavity 30 of the hollow wall 28 in a checkerboard or parquet pattern. Each series or plurality of fibrous insulation blanket strips 50 and 52 are located in the enclosed cavity 30 so that the major surfaces 22 and 24 of the fibrous insulation blanket strips 50 and 52 are perpendicular or substantially perpendicular to the skins or panels 32 and 34 of the enclosed cavity 30. Where the fibers of the fibrous insulation blankets 20 and thus the strips 50 and 52 predominately lie in and are randomly oriented in planes extending parallel to or substantially parallel to the major surfaces 22 and 24 of the fibrous insulation blanket strips 50 and 52, the higher air flow resistant direction through the fibrous insulation blanket strips 50 and 52 is normal to the major surfaces 22 and 24 of the fibrous insulation blanket strips. With these fibrous insulation blanket strips 50 oriented vertically within the enclosed cavity 30 with the major surfaces of the fibrous insulation blanket strips 50 perpendicular or substantially perpendicular to the skins or panels 32 and 34 of the enclosed cavity, the fibrous insulation blanket strips 50 more effectively dissipate or drain the airborne resonance energy within the enclosed cavity and prevent airborne resonance buildup within the enclosed cavity in a first direction (horizontal as shown in FIG. 4) parallel with the skins or panels 32 and 34 of the enclosed cavity. With the fibrous insulation blanket strips 52 positioned or oriented horizontally within the enclosed cavity 30 with the major surfaces of the fibrous insulation blanket strips 52 perpendicular or substantially perpendicular to the skins or panels 32 and 34 of the structural cavity, the fibrous insulation blanket strips 52 more effectively dissipate or drain the airborne resonance energy within the enclosed cavity and prevent airborne resonance buildup within the enclosed cavity in a second direction (vertical as shown in FIG. 4) parallel with the skins or panels 32 and 34 of the enclosed cavity.

FIG. 5 shows an alternative checkerboard or parquet pattern of damping materials which can be used in the enclosed cavity of FIG. 4. In the pattern shown in FIG. 5, in addition to the fibrous insulation strips 50 and 52, there are fibrous insulation strips 54 and 56 which both may be in modular form and are oriented at angles to both the vertical and the horizontal. While not shown it is also contemplated that all of the fibrous insulation strips forming the checkerboard or parquet pattern of damping material could be installed in the same manner as the fibrous insulation strips 54 and 56 without any fibrous insulation strips installed in the vertical and horizontal directions like strips 50 and 52. In addition, for certain selected applications it may be desirable to use damping material layers 50, 52, 54 and/or 56 of different damping materials (either faced or unfaced) exhibiting anisotropic air flow resistance properties, such as but not limited to, glass fiber blankets and polymeric fiber blankets, combinations of different mineral fiber blankets, fibrous blankets and other damping materials such as foam, or porous foam sheets and other porous damping materials.

FIGS. 6 and 7 show layered embodiments of the present invention wherein a first layer or layers of anisotropic porous damping material 80 are installed in the enclosed cavity 30 of a hollow wall in the conventional manner with the higher air flow resistant direction through the damping material extending generally perpendicular to the skins 32 and 34 of the enclosed cavity to damp airborne resonance in a direction normal to the skins 32 and 34 of the enclosed cavity. A second layer or layers are of anisotropic porous damping materials 82 (FIG. 6) and 84 and 86 (FIG. 7) are also installed in the enclosed cavity 30 to damp airborne resonance in directions other than normal to the skins 32 and 34 of the cavity (e.g. at acute angles to or parallel with the skins 32 and 34). While the second layer or layers of FIGS. 6 and 7 are as shown in FIGS. 1 and 4, the second layers can be installed as shown and described in connection with any of FIGS. 1–5. In addition, for certain selected applications it may be desirable to use damping material layers 80, 82, 84 and/or 86 of different damping materials (either faced or unfaced) exhibiting anisotropic air flow resistance properties, such as but not limited to, glass fiber blankets and polymeric fiber blankets, combinations of different mineral fiber blankets, fibrous blankets and other damping materials such as foam, or porous foam sheets and other porous damping materials.

FIG. 8 shows a another preferred embodiment of the present invention wherein the peripheries of the enclosed cavities 30 are insulated in whole or in part and an air space 60 free of insulation remains in the central portion of the enclosed cavities 30. As shown, the fibrous insulation blanket strips 62 extend vertically along the opposed vertical sidewalls 66 of the enclosed cavities 30 and the fibrous insulation blanket strips 64 extend horizontally along the opposed horizontally extending sidewalls 68 of the enclosed cavities. While it is preferred to insulate both pairs of opposed sidewalls 66 and 68 with the fibrous insulation blanket strips 62 and 64, only one pair of opposed sidewalls can be insulated. As shown, where the fibers of the fibrous insulation blanket strips 62 and 64 predominately lie in and are randomly oriented in planes extending parallel with or substantially parallel with the major surfaces of the blankets, the fibrous insulation blanket strips 62 (like the fibrous insulation blanket strips 50 used in one preferred embodiment of FIG. 4) dampen airborne resonance buildup in a horizontal direction parallel with the skins or panels 32 and 34 of the enclosed cavities 30 and the fibrous insulation blanket strips 64 (like the fibrous insulation blanket strips 52 used in one preferred embodiment of FIG. 4) dampen airborne resonance buildup in a vertical direction parallel with the skins or panels 32 and 34 of the enclosed cavities 30.

With the embodiment of FIG. 8, the weight of the insulation in the enclosed cavity 30 is reduced while maintaining most of the airborne resonance damping properties of the other embodiments. Thus, this arrangement may be of particular interest for aircraft fuselages where weight reduction is an important design criteria. As with the embodiments of FIGS. 1–7, for certain selected applications it may be desirable to use damping material layers 62 and/or 64 of different damping materials (either faced or unfaced) exhibiting anisotropic air flow resistance properties, such as but not limited to, glass fiber blankets and polymeric fiber blankets, different mineral fiber blankets, fibrous blankets and other damping materials, or other porous damping materials.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A sound controlled enclosed cavity comprising:

a first skin and a second skin, the second skin being spaced from the first skin whereby two surfaces of the enclosed cavity are defined by the first and second skins;

a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces; the damping material being a fibrous blanket of insulation wherein fibers of the fibrous blanket lie predominately in planes extending parallel to or substantially parallel to the first and second surfaces of the fibrous blanket; and the fibrous blanket being positioned within the enclosed cavity between the first and second skins so that the first and second surfaces of the fibrous blanket and the fibers lie in planes extending at an acute angle to or perpendicular to the first and second skins of the enclosed cavity to damp airborne resonance buildup within the enclosed cavity in a direction at an acute angle to or parallel with the first and second skins of the enclosed cavity.

2. A sound controlled enclosed cavity comprising:

a first skin and a second skin, the second skin being spaced from the first skin whereby two surfaces of the enclosed cavity are defined by the first and second skins;

a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces; the damping material being a fibrous blanket of insulation wherein fibers of the fibrous blanket lie predominately in planes extending at an acute angle to the first and second surfaces of the fibrous blanket; and the fibrous blanket being positioned within the enclosed cavity between the first and second skins so that the first and second surfaces of the fibrous blanket and the fibers lie in planes extending at an acute angle to or perpendicular to the first and second skins of the enclosed cavity to damp airborne resonance buildup within the enclosed cavity in a direction at an acute angle to or parallel with the first and second skins of the enclosed cavity.

3. A sound controlled enclosed cavity comprising:

a first skin and a second skin, the second skin being spaced from the first skin whereby two surfaces of the enclosed cavity are defined by the first and second skins;

a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces; there being a series of layers of the damping material within said structural cavity between the first and second skins of the enclosed cavity so that the first and second surfaces of each of the series of damping material layers lie in planes extending at an acute angle to or perpendicular to the first and second skins of the enclosed cavity to damp airborne resonance buildup within the structural cavity in a direction at an acute angle to or parallel with the first and second skins of the enclosed cavity.

4. The sound controlled enclosed cavity according to claim 3, wherein:

the damping material of at least one of the damping material layers is a fibrous blanket of insulation wherein fibers of the fibrous blanket lie predominately in planes extending parallel to or substantially parallel with the first and second surfaces of the fibrous blanket; and the fibrous blanket is positioned within the enclosed cavity between the first and second skins so that the first and second surfaces of the fibrous blanket and the fibers lie in planes extending at an acute angle to or perpendicular to the first and second skins of the enclosed cavity to damp airborne resonance buildup within the enclosed cavity in a direction parallel with the first and second skins.

5. The sound controlled enclosed cavity according to claim 3, wherein:

the damping material of at least one of the damping material layers is a fibrous blanket of insulation wherein fibers of the fibrous blanket lie predominately in planes extending at an acute angle to the first and second surfaces of the fibrous blanket; and the fibrous blanket is positioned within the enclosed cavity between the first and second skins so that the first and second surfaces of the fibrous blanket and the fibers lie in planes extending at an acute angle to or perpendicular to the first and second skins of the enclosed cavity to damp airborne resonance buildup within the enclosed cavity in a direction parallel with the first and second skins.

6. The sound controlled enclosed cavity according to claim 3, wherein:

the damping material of at least one damping material layer differs from the damping material of another of the damping material layers.

7. The sound controlled enclosed cavity according to claim 3, wherein:

the enclosed cavity is a portion of a fuselage wall of an aircraft.

8. The sound controlled enclosed cavity according to claim 4, wherein:

the enclosed cavity is in a wall, ceiling, floor or roof of a building structure.

9. A sound controlled enclosed cavity comprising:

a first skin and a second skin, the second skin being spaced from the first skin whereby two surfaces of the enclosed cavity are defined by the first and second skins;

a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces;

the damping material being positioned within the enclosed cavity between the first and second skins so that the first and second surfaces of the damping material lie in planes extending at an acute angle to perpendicular to the first and second skins of the enclosed cavity to damp airborne resonance buildup within the enclosed cavity in a direction at an acute angle to or parallel with the first and second skins of the enclosed cavity;

a layer of damping material having first and second surfaces and anisotropic air flow resistance properties wherein the air flow resistance per unit length in a direction intersecting the first and second surfaces of the layer of damping material is greater than the air flow resistance per unit length in a direction parallel with the first and second surfaces of the layer of damping material; and the layer of damping material being positioned within the enclosed cavity between the first and second skins so that the first and second surfaces of the layer of damping material lie in planes extending parallel with the first and second skins of the enclosed cavity to damp airborne resonance buildup within the enclosed cavity in a direction perpendicular to the first and second skins of the enclosed cavity.

10. A sound controlled enclosed cavity comprising:

a first skin and a second skin, the second skin being spaced from the first skin whereby two surfaces of the enclosed cavity are defined by the first and second skins;

a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces;

a first series of layers of the damping material positioned within the enclosed cavity between the first and second skins so that the first and second surfaces each of the first series of layers lie in planes extending at an acute angle to or perpendicular to the first and second skins of the enclosed cavity to damp airborne resonance buildup within the enclosed cavity in a first direction at an acute angle to or parallel with the first and second skins of the enclosed cavity; and a second series of layers of the damping material positioned within the enclosed cavity between the first and second skins so that the first and second surfaces of each of the second series of layers lie in planes extending at an acute angle to or perpendicular to the first and second skins of the enclosed cavity to damp airborne resonance buildup within the enclosed cavity in a second direction at an acute angle to or parallel with the first and second skins the enclosed cavity.

11. The sound controlled enclosed cavity according to claim 10, wherein:

the first direction and the second direction are oriented at an angle of about 90° with respect to each other.

12. The sound controlled enclosed cavity according to claim 10, including:

a layer of damping material having first and second surfaces and anisotropic air flow resistance properties wherein the air flow resistance per unit length in a direction intersecting the first and second surfaces of the layer of damping material is greater than the air flow resistance per unit length in a direction parallel with the first and second surfaces of the layer of damping material; and the layer of damping material being positioned within the enclosed cavity between the first and second skins so that the first and second surfaces of the layer of damping material lie in planes extending parallel with the first and second skins of the enclosed cavity to damp airborne resonance buildup within the enclosed cavity in a direction perpendicular to the first and second skins of the enclosed cavity.

13. A method of sound control in an enclosed cavity having a first skin and a second skin, the second skin being spaced from the first skin whereby two surfaces of the enclosed cavity are defined by the first and second skins, comprising:

providing a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces; the damping material being a fibrous blanket of insulation wherein fibers of the fibrous blanket lie predominately in planes extending parallel with or substantially parallel with the first and second surfaces of the fibrous blanket; and placing the fibrous blanket within the enclosed cavity between the first and second skins so that the first and second surfaces of the fibrous blanket and the fibers lie in planes extending at an acute angle to or perpendicular to the first and second skins of the enclosed cavity to damp airborne resonance buildup within the enclosed cavity in a direction at an acute angle to or parallel with the first and second skins of the enclosed cavity.

14. A method of sound control in an enclosed cavity having a first skin and a second skin, the second skin being spaced from the first skin whereby two surfaces of the enclosed cavity are defined by the first and second skins, comprising:

providing a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces; the damping material being a fibrous blanket of insulation wherein fibers of the fibrous blanket lie predominately in planes extending at an acute angle to the first and second surfaces of the fibrous blanket; and placing the fibrous blanket within the enclosed cavity between the first and second skins so that the first and second surfaces of the fibrous blanket and the fibers lie in planes extending at an acute angle to or perpendicular to the first and second skins of the enclosed cavity to damp airborne resonance buildup within the enclosed cavity in a direction at an acute angle to or parallel with the first and second skins of the enclosed cavity.

15. A method of sound control in an enclosed cavity having a first skin and a second skin, the second skin being spaced from the first skin whereby two surfaces of the enclosed cavity are defined by the first and second skins, comprising:

providing a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces;

placing a series of layers of the damping material within the enclosed cavity between the first and second skins of the enclosed cavity so that the first and second surfaces of each of the series of damping material layers lie in planes extending at an acute angle to or perpendicular to the first and second skins of the enclosed cavity to damp airborne resonance buildup within the enclosed cavity in a direction at an acute angle to or parallel with the first and second skins of the enclosed cavity.

16. The method of sound control in an enclosed cavity according to claim 15, wherein:

the damping material of at least one of the damping material layers is a fibrous blanket of insulation wherein fibers of the fibrous blanket lie predominately in planes extending parallel with or substantially parallel with the first and second surfaces of the fibrous blanket; and the fibrous blanket is placed within the enclosed cavity between the first and second skins so that the first and second surfaces of the fibrous blanket and the fibers lie in planes extending at an acute angle to or perpendicular to the first and second skins of the enclosed cavity to damp airborne resonance buildup within the enclosed cavity in a direction parallel with the first and second skins.

17. The method of sound control in an enclosed cavity according to claim 15, wherein:

the damping material of at least one of the damping material layers is a fibrous blanket of insulation wherein fibers of the fibrous blanket lie predominately in planes extending at an acute angle to the first and second surfaces of the fibrous blanket; and the fibrous blanket is placed within the enclosed cavity between the first and second skins so that the first and second surfaces of the fibrous blanket and the fibers lie in planes extending at an acute angle to or perpendicular to the first and second skins of the enclosed cavity to damp airborne resonance buildup within the enclosed cavity in a direction parallel with the first and second skins.

18. The method of sound control in an enclosed cavity according to claim 15, wherein:

the damping material of at least one damping material layer differs from the damping material of another of the damping material layers.

19. The method of sound control in an enclosed cavity according to claim 15, wherein:

the enclosed cavity is a portion of a fuselage wall of an aircraft.

20. The method of sound control in an enclosed cavity according to claim 15, wherein:

the enclosed cavity is in a wall, ceiling, floor or roof of a building structure.

21. A method of sound control in an enclosed cavity having a first skin and a second skin, the second skin being spaced from the first skin whereby two surfaces of the enclosed cavity are defined by the first and second skins, comprising:

providing a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces;

placing a first series of layers of the damping material within the enclosed cavity between the first and second skins so that the first and second surfaces each of the first series of layers lie in planes extending at an acute angle to or perpendicular to the first and second skins of the enclosed cavity to damp airborne resonance buildup within the enclosed cavity in a first direction at an acute angle to or parallel with the first and second skins of the enclosed cavity; and placing a second series of layers of the damping material within the enclosed cavity between the first and second skins so that the first and second surfaces of each of the second series of layers lie in planes extending at an acute angle to or perpendicular to the first and second skins of the enclosed cavity to damp airborne resonance buildup within said enclosed cavity in a second direction at an acute angle to or parallel with the first and second skins of the enclosed cavity.

22. The method of sound control in an enclosed cavity according to claim 21, wherein:

the first direction and the second direction are oriented at an angle of about 90° with respect to each other.

23. A method of sound control within an enclosed cavity having a first skin and a second skin, the second skin being spaced from the first skin whereby first and second surfaces of the enclosed cavity are defined by the first and second skins; and a first frame member and a second frame member, the first and second frame members being spaced apart from and extending substantially parallel with respect to each other between the first and second skins whereby the first and second frame members define third and fourth surfaces of the enclosed cavity; comprising:

providing a damping material having first and second surfaces and anisotropic air flow resistance properties wherein the air flow resistance per unit length in a direction intersecting the first and second surfaces of the damping material is greater than the air flow resistance per unit length in a direction parallel with the first and second surfaces; and placing the damping material within the enclosed cavity between the first and second skins and adjacent the third and fourth surfaces of the enclosed cavity so that the first and second surfaces of the damping material lie in planes extending at an acute angle to or perpendicular to the first and second skins of the enclosed cavity to damp airborne resonance buildup within the enclosed cavity in a direction at an acute angle or parallel with the first and second skins of the enclosed cavity; and leaving a non-insulated, substantially centrally located air space within the enclosed cavity extending between the first and second skins and having at least two sides defined by first spaced apart, opposed surfaces of the damping material.

24. The method of sound control within an enclosed cavity according to claim 23, wherein:

four sides of the non-insulated air space are defined by the first spaced apart, opposed surfaces of the damping material and second spaced apart, opposed surfaces of the damping material.

25. The method of sound control in an enclosed cavity according to claim 23, wherein:

the enclosed cavity is a portion of a fuselage wall of an aircraft.

26. The method of sound control in an enclosed cavity according to claim 23, wherein:

the enclosed cavity is in a wall, ceiling, floor or roof of a building structure.

27. The method of sound control in an enclosed cavity according to claim 23, wherein:

the damping material is a fibrous blanket damping material.

28. The method of sound control in an enclosed cavity according to claim 23, wherein:

the damping material is a foam material.

29. A sound controlled enclosed cavity comprising:

a first skin and a second skin, the second skin being spaced from the first skin whereby first and second surfaces of the enclosed cavity are defined by the first and second skins; and a first frame member and a second frame member, the first and second frame members being spaced apart from and extending substantially parallel with respect to each other between the first and second skins whereby the first and second frame members define third and fourth surfaces of the enclosed cavity;

a damping material having first and second surfaces and anisotropic air flow resistance properties, wherein the air flow resistance per unit length in a direction intersecting the first and second surfaces of the damping material is greater than the air flow resistance per unit length in a direction parallel with the first and second surfaces, positioned within the enclosed cavity between the first and second skins and adjacent to the third and fourth surfaces of the enclosed cavity so that the first and second surfaces of the damping material lie in planes perpendicular to or substantially perpendicular to the first and second skins of the enclosed cavity to damp airborne acoustical resonance buildup within the enclosed cavity in a direction at an acute angle or parallel with the first and second skins of the enclosed cavity; and a non-insulated, substantially centrally located air space within the enclosed cavity extending between the first and second skins and having at least two sides defined by first spaced apart, opposed surfaces of the damping material.

30. The sound controlled enclosed cavity according to claim 29, wherein:

four sides of said non-insulated air space are defined by the first spaced apart, opposed surfaces of the damping material and second spaced apart, opposed surfaces of the damping material.

31. The sound controlled enclosed cavity according to claim 29, wherein:

the enclosed cavity is a portion of a fuselage wall of an aircraft.

32. The sound controlled enclosed cavity according to claim 29, wherein:

the enclosed cavity is in a wall, ceiling, floor or roof of a building structure.

33. The sound controlled enclosed cavity according to claim 29, wherein:

the damping material is a fibrous blanket damping material.

34. The sound controlled enclosed cavity according to claim 29, wherein:

the damping material is a foam material.

35. A method of sound control in an enclosed cavity having a first skin and a second skin, the second skin being spaced from the first skin whereby two surfaces of the enclosed cavity are defined by the first and second skins, comprising:

providing a foam damping material having first and second surfaces and anisotropic air flow resistance properties wherein the air flow resistance per unit length in a direction intersecting the first and second surfaces of the foam damping material is greater than the air flow resistance per unit length in a direction parallel with the first and second surfaces; and placing the foam damping material within the enclosed cavity between the first and second skins so that the first and second surfaces of the foam damping material lie in planes at an acute angle to or perpendicular to the first and second skins of the enclosed cavity to damp airborne resonance buildup within the enclosed cavity in a direction at an acute angle to or parallel with the first and second skins of the enclosed cavity.

36. A sound controlled enclosed cavity comprising:

a first skin and a second skin, the second skin being spaced from the first skin whereby two surfaces of the enclosed cavity are defined by the first and second skins;

a foam damping material having first and second surfaces and anisotropic air flow resistance properties wherein the air flow resistance per unit length in a direction intersecting the first and second surfaces of the foam damping material is greater than the air flow resistance per unit length in a direction parallel with the first and second surfaces; and the foam damping material being positioned within the enclosed cavity between the first and second skins so that the first and second surfaces of the foam damping material lie in planes extending at an acute angle to perpendicular to the first and second skins of the enclosed cavity to damp airborne resonance buildup within the enclosed cavity in a direction at an acute angle to or parallel with the first and second skins of the enclosed cavity.

* * * * *